US006912883B2

(12) United States Patent
Sakai

(10) Patent No.: US 6,912,883 B2
(45) Date of Patent: Jul. 5, 2005

(54) LOAD MEASURING SYSTEM FOR A THREAD ROLLING MACHINE AND OPERATING METHOD THEREFOR

(75) Inventor: Takeshi Sakai, Fujisawa (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/395,123

(22) Filed: Mar. 25, 2003

(65) Prior Publication Data

US 2004/0045332 A1 Mar. 11, 2004

(30) Foreign Application Priority Data

Mar. 26, 2002 (JP) ..... 2002-085446

(51) Int. Cl.[7] ..... B21B 37/58

(52) U.S. Cl. ..... 72/14.4; 72/21.4; 72/104; 470/45

(58) Field of Search ..... 72/10.1, 10.4, 72/13.4, 14.4, 17.1, 17.2, 20.1, 21.4, 88, 102, 104, 108; 470/10, 44, 45, 66

(56) References Cited

U.S. PATENT DOCUMENTS

| | | | | |
|---|---|---|---|---|
| 3,712,094 A | * | 1/1973 | Motz et al. | 72/13.4 |
| 3,733,867 A | | 5/1973 | Prutton | 72/93 |
| 4,487,044 A | | 12/1984 | Fapiano | 72/8 |
| 4,615,197 A | | 10/1986 | Allebach | 72/88 |
| 5,528,917 A | * | 6/1996 | Bajraszewski et al. | 72/10.6 |
| 5,555,757 A | | 9/1996 | Smith et al. | 72/88 |
| 6,116,073 A | | 9/2000 | Kajiwara et al. | 72/242.4 |
| 6,418,767 B2 | * | 7/2002 | Shinbutsu et al. | 72/10.2 |
| 6,729,171 B2 | * | 5/2004 | Ladousse et al. | 72/108 |

FOREIGN PATENT DOCUMENTS

| | | | | |
|---|---|---|---|---|
| DE | 3127462 | * | 3/1983 | B21H/3/00 |
| JP | 3-110035 | | 5/1991 | 72/104 |

OTHER PUBLICATIONS

English Language Abstract of JPA 3–110035 (Ref. F above).

* cited by examiner

*Primary Examiner*—Ed Tolan
(74) *Attorney, Agent, or Firm*—Adduci, Mastriani & Schaumberg, LLP

(57) ABSTRACT

A thread rolling machine forming a threaded member from a workpiece includes a die, a device for rotating the die, a device for generating a load applied to the die in a workpiece-feeding direction, a member that deforms under the applied load during a thread rolling operation, a strain gauge that generates a signal indicative of the deformation of the member under the applied load, and a computer that calculates the load applied during thread rolling operation based on the signal generated by the strain gauge. The computer can generate a feedback signal permitting control of the applied load generated by the thread rolling machine by controlling either the load generating device or the die-rotating device. An operating method for a thread rolling machine is also described.

20 Claims, 3 Drawing Sheets

LOAD MEASURING SYSTEM FOR A THREAD ROLLING MACHINE AND OPERATING METHOD THEREFOR

BACKGROUND OF THE INVENTION

The present invention relates generally to thread rolling machines. More specifically, the present invention relates to a load measuring system for a thread rolling machine that generates feedback signals for controlling the load developed by the thread rolling machine. An operating method for a thread rolling machine is also disclosed.

The present application is based on Japanese Patent Application No. 2002-085446, which application is incorporated, in its entirety, by reference.

Heretofore, thread rolling machines were employed to form threads on a workpiece. More specifically, a die having a configuration that is the inverse, i.e., mirror image, of the desired screw thread was pressed onto a workpiece while rotating the workpiece numerous times. The thread rolling machines were usually manually controlled. In other words, during the rolling operation, machining conditions such as frame pitch adjustment, load, and compression time were determined based on the experience of the operator. Therefore, the machining conditions required during thread rolling could not be quantified, making it difficult, if not impossible, to reduce the variability in the machining conditions and, thus, the resultant machined thread variations flowing from the experience and perceptual differences among operators. In short, manually controlled thread rolling machines lead to variations in product accuracy at the lot unit level.

Take, for example, the case in which a so-called circular die-type thread rolling machine is employed in producing a threaded workpiece. In such a thread rolling machine, a hydraulic cylinder is frequently employed to supply the die-driving force needed to feed the die that applies the necessary thread rolling load to the workpiece. In an effort to obtain information that would permit reduced variability of the threaded end product, these hydraulically powered thread rolling machines permitted the load at the time that the thread rolling was actually being performed to be determined by measuring the hydraulic pressure within the hydraulic cylinder and, then, multiplying the surface area of the hydraulic cylinder by the pressure measurement.

It will be noted that the load applied during the thread rolling processed obtained from the hydraulic cylinder driving the die is actually the force delivered at the output side of the thread rolling machine. This load value contains inherent errors due, for example, to flexure of the structural members of the thread rolling machine and/or the characteristics of the hydraulic circuit, e.g., pressure drops in the line supplying the pressure gauge. Consequently, the actual load applied during the thread rolling operation is different from the load determined using the hydraulic cylinder. Thus, hydraulic cylinder pressure data is not well suited for performing load control during the thread rolling operation, since the pressure data will not permit thread rolling machine control at the desired degree of precision.

It will be appreciated that the use of stress and strain gauges in connection with various rolling and/or milling machines is known. For example, U.S. Pat. No. 4,615,197 to Allebach discloses the use of strain gages in connection with a flat die thread rolling machine for the purpose of ascertaining the alignment of the fixed and movable dies relative to one another. More specifically, the reaction force exerted on the fixed die in a vertical direction during the thread rolling operation is measured; the load applied between the fixed and movable dies is not measured. In contrast, U.S. Pat. No. 4,487,044 to Fapiano and U.S. Pat. No. 6,116,073 to Kajiwara et al. each disclose the use of a load cell in a rolling mill employed in directly measuring the force applied in working a piece of bar stock. It will be noted that the load cell(s) must be sized the support the entire working load of the rolling mill, rather than measuring the stress or stain induced in, for example, a hydraulic piston shaft indicative of the working load. Thus, the size and cost of the measurement system cannot be optimized.

What is needed is a load measurement system that accurately determines the load applied to a workpiece disposed in a thread rolling machine. It would be desirable in the load measurement system could be integrated into the thread rolling machine to permit either automatic of manual control of the load developed by the thread rolling machine when the actual load deviates from a predetermined load. It would be particularly advantageous if the thread rolling machine generated a feedback signal that could be applied in multiple load control schemes.

SUMMARY OF THE INVENTION

Based on the above and foregoing, it can be appreciated that there presently exists a need in the art for a control system for a thread rolling machine that overcomes the above-described deficiencies. The present invention was motivated by a desire to overcome the drawbacks and shortcomings of the presently available technology, and thereby fulfill this need in the art.

In one aspect, the present invention provides a load measurement system for a thread rolling machine forming a threaded member from a workpiece, including a member that deforms under a load applied to the workpiece during a thread rolling operation, a strain gauge that generates a signal indicative of the deformation of the member under the applied load, and a computer that calculates the load applied to the workpiece during thread rolling operation based on the signal generated by the strain gauge. In an exemplary case, the member deforms in a direction parallel to the direction of the applied load. Moreover, the member can include a tension bar disposed in a direction parallel to the direction of the applied load. If desired, the computer can generate a feedback signal permitting the computer to control the applied load generated by the thread rolling machine. The load measurement system can be applied to a circular die-type thread rolling machine.

In another aspect, the present invention provides a thread rolling machine forming a threaded member from a workpiece, including a die, a device for rotating the die, a device for generating a load applied to the die in a workpiece-feeding direction, a member that deforms under the applied load during a thread rolling operation, a strain gauge that generates a signal indicative of the deformation of the member under the applied load, and a computer that calculates the load applied during thread rolling operation based on the signal generated by the strain gauge. In an exemplary case, the member deforms in a direction parallel to the direction of the applied load. The member can include a tension bar disposed in a direction parallel to the direction of the applied load. If desired, the computer can generate a feedback signal permitting the computer to control the applied load generated by the thread rolling machine by controlling the output of the load generating device. The feedback signal can be employed to control the position of the flow control valve when the load generating device includes a hydraulic cylinder supplied with hydraulic fluid via an electrically operated flow control valve. Alternatively, the feedback signal can be employed to control the applied load generated by the thread rolling machine by controlling rotation of the rotating device when the rotating device includes an electric motor. In either case, the thread rolling machine can be a circular die-type thread rolling machine.

In a further aspect, the present invention provides a method for operating a thread rolling machine including a die, a die-rotating device, and a die-feeding device generating an applied load in the die-feeding direction, and a member that deforms under the applied load during a thread rolling operation. The method includes steps for generating a deformation signal indicative of the deformation of the member under the applied load, calculating an actual load applied during thread rolling operation based on the deformation signal, comparing the actual load to a predetermined load value to thereby determine a variance value, generating a feedback signal responsive the variance value, and applying the feedback signal to the thread rolling machine to thereby control the applied load generated by the thread rolling machine. If desired, the feedback signal can be applied the thread rolling machine as a control signal to the die-feeding device or as a control signal to the die-rotating device. The thread rolling machine can be a circular die-type thread rolling machine.

BRIEF DESCRIPTION OF THE DRAWINGS

These and various other features and aspects of the present invention will be readily understood with reference to the following detailed description taken in conjunction with the accompanying drawings, in which like or similar numbers are used throughout, and in which.

DETAILED DESCRIPTION OF THE PREFERRED EMBODIMENTS

Figure 1:
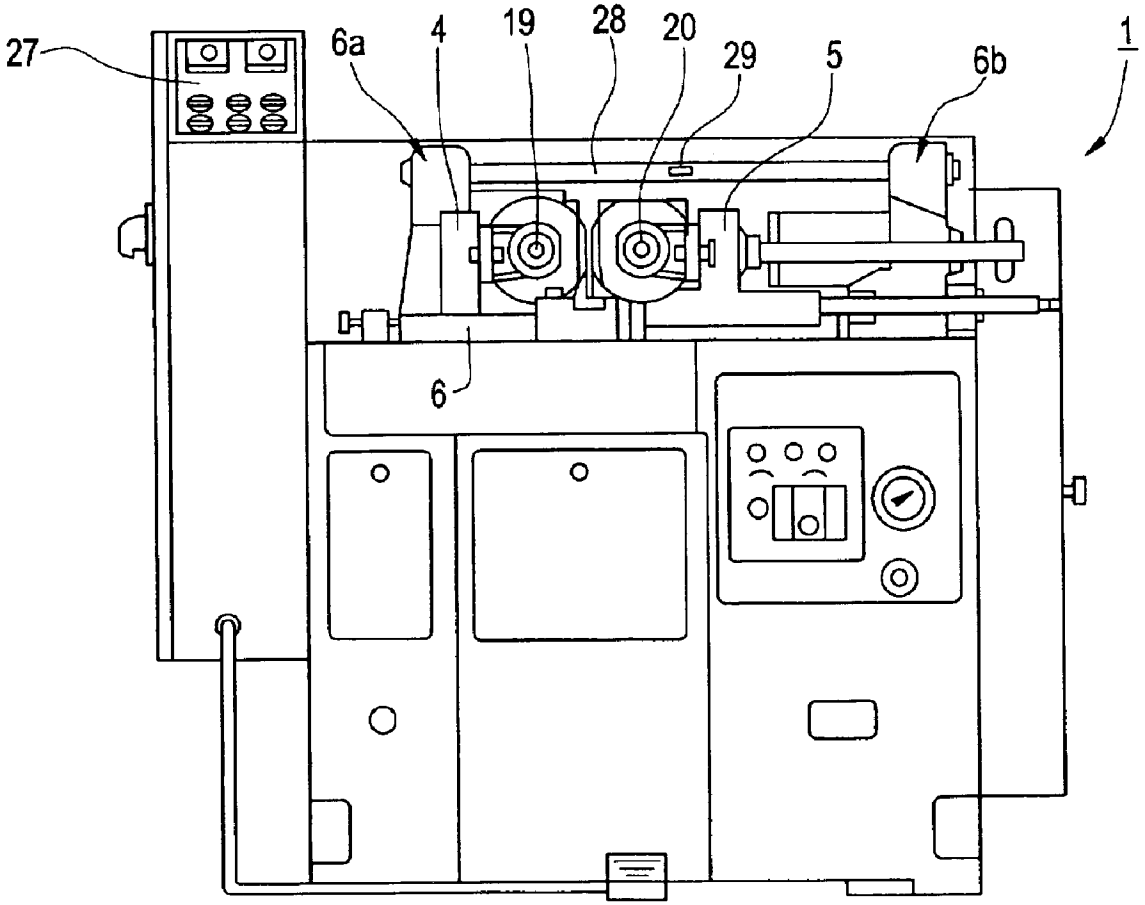
FIG. 1 is a schematic diagram showing the main body of a thread-rolling machine of an exemplary embodiment of the present invention.
Figure 2:
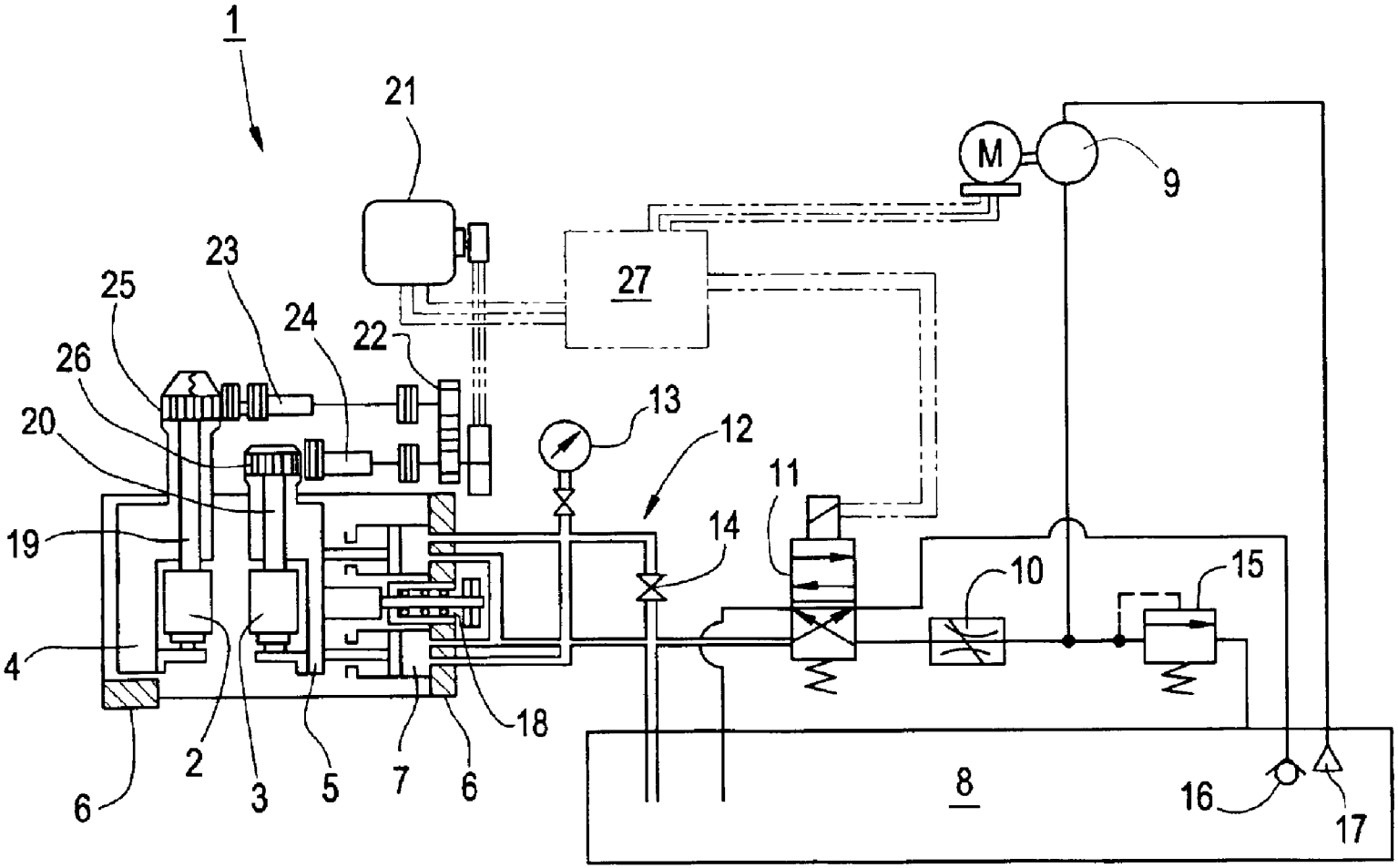
FIG. 2 is a schematic diagram of the thread-rolling machine shown in FIG. 1.

FIG. 1 illustrates an exemplary embodiment of a thread rolling machine 1 according to the present invention in mechanical terms while FIG. 2 illustrates the thread rolling machine in terms of hydraulic circuitry. The thread rolling machine 1 carries out thread rolling by using two roll dies 2, 3 and, thus, is known as a circular die-type thread rolling machine. The thread rolling machine 1 is more specifically referred to as a fixed shaft mobile dual die thread rolling machine due to the fact that one roll die 2 is attached to a fixed spindle stock 4, and the other roll die 3 is attached to a movable spindle stock 5.

It will be appreciated that the fixed spindle stock 4 is directly secured to a base 6. In contrast, the movable spindle stock 5 is secured to the base 6 via a hydraulic cylinder 7, so that the movable spindle stock 5 can slide on the base 6. It will also be appreciated that the feed volume of the roll die 3 with respect to the roll die 2 can be determined by varying the distance of the movable spindle stock 5 with respect to the fixed spindle stock 4.

Referring specifically to FIG. 2. It will be appreciated that the operating fluid for the hydraulic cylinder 7 is drawn upward from a hydraulic reservoir 8 by a hydraulic pump 9 and is supplied to the cylinder chamber on the extension operation side of the hydraulic cylinder 7 via a rolling speed regulating valve 10 and a direction-switching spool valve 11. It should be noted that a pressure gauge 13, an air exhaust valve 14, i.e., a bleed valve, an oil pressure regulating valve 15, a back pressure regulating valve 16, and a filter 17 are also included in hydraulic circuit 12 that supplies operating fluid to the hydraulic cylinder 7. A reset spring 18 is provided between the base 6 and the movable spindle stock 5 as a power source for retracting the hydraulic cylinder 7. The cylinder 7 advantageously can include multiple cylinders disposed in parallel, as shown in FIG. 2.

Driving spindles 19 and 20, which are coupled to roll dies 2 and 3, are rotatably supported by the fixed spindle stock 4 and the movable spindle stock 5, respectively. The power transmitted to the roll dies 2 and 3 is provided by a spindle-driving motor 21 via a transmission 22, pitch adjustment couplings 23 and 24 and worm gears 25 and 26, respectively, which elements are, in an exemplary case, arranged in the recited order. It should be noted that hydraulic motor M that drives the hydraulic pump 9, the spindle driving motor 21, and the direction switching valve 11 are controlled by means of a controller 27, which advantageously can include a computer 27*a*.

The thread-rolling machine 1 is also provided with a tension bar 28 (shown only in FIG. 1) that links a first base extension 6*a* fixedly coupled to the fixed spindle stock 4 with a second base extension 6*b*, which secures and supports the hydraulic cylinder 7 to the base 6. The tension bar 28 is a flexible shaft member disposed in the feed direction of, i.e., parallel to, the direction of movement of roll die 3. It will be appreciated that the tension bar 28 is an element subject to distortion when the reaction force is applied during the thread rolling operation. In the exemplary case under discussion, the tension bar 28 is provided with a strain gauge 29. It will be appreciated that the controller 27 advantageously includes suitable circuitry for obtaining the load applied to the workpiece during the thread rolling operation from the output of the strain gauge 29, as discussed below. The output of the strain gauge 29 can be converted to the applied load of the thread rolling machine 1 by calculations performed by the computer 27*a*. In other words, the force applied to the die 3 is reflected as a strain in the tension bar 28, which advantageously can be measured by the strain gauge 29.

Figure 3:
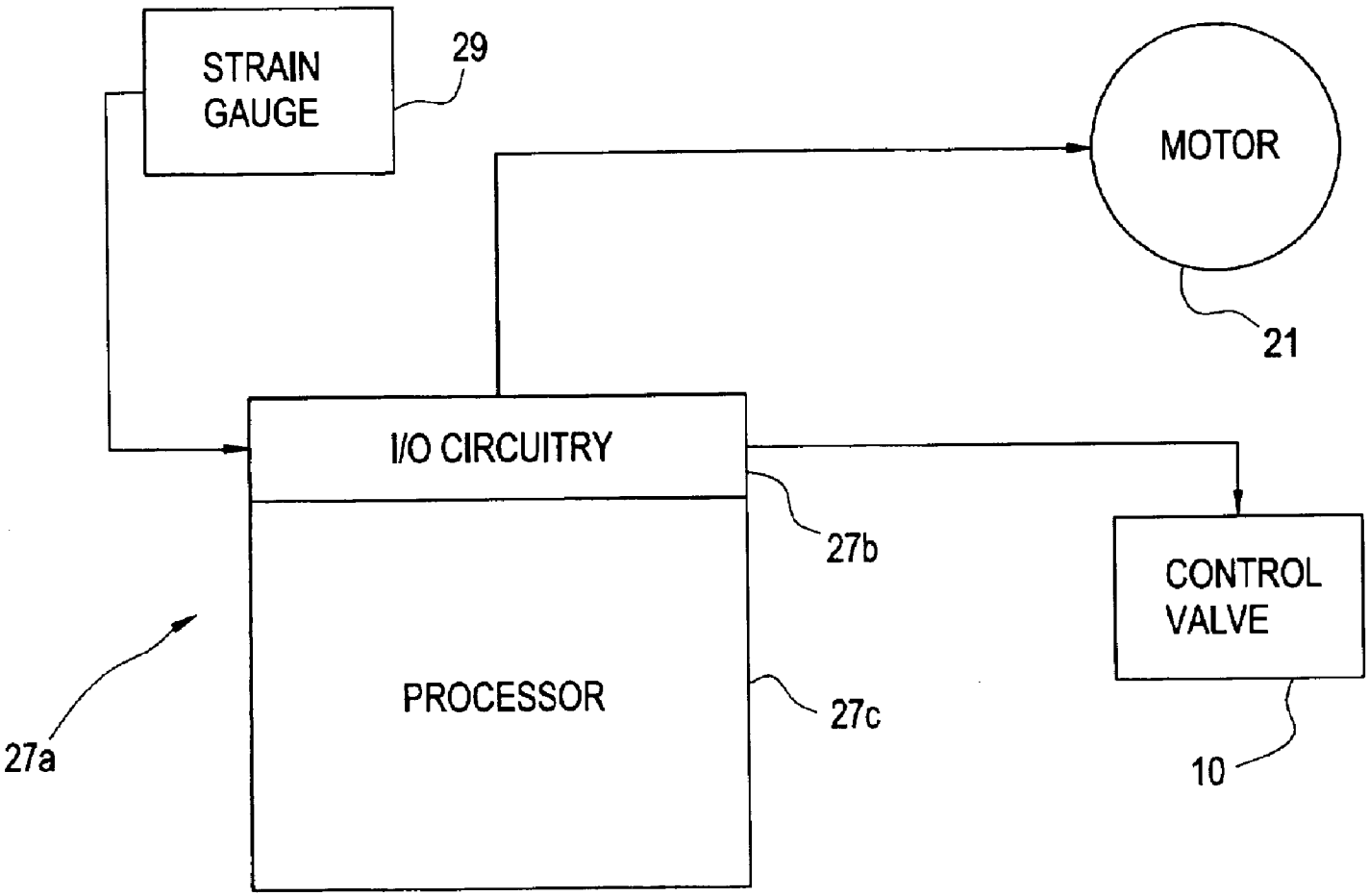
FIG. 3 is a high-level block diagram of selected portions of the controller and attendant control circuitry illustrated in FIGS. 1 and 2.

As illustrated in FIG. 3, the computer 27*a* includes both an input/output (I/O) circuit 27*b* and a processor 27*c*. The processor 27*b* receives data from the strain gauge 29 via the I/O circuitry 27*b* and employs that data to calculate the load developed during the thread rolling operation. The processor 27*c* advantageously can compare the calculated load to a desired load (or load profile) and generate one or more feedback values, which can be provided as feedback signals via the I/O circuitry 27*b* to, for example, the motor 21 and/or the flow control valve 10 controlling the hydraulic cylinder 7.

It should be noted that the controller 27 enables feedback control of the feed volume of the roll die 3, based on the load applied during the thread rolling operation, by computing the load during the thread rolling operation based on the distortion of the tension bar 28 measured by the strain gauge 29, comparing this load with a predetermined load, and providing control signals to the spindle-driving motor 21 to thereby ensure that the load applied during the thread rolling operation is the desired load for the threaded workpiece being produced. It will be noted that the predetermined load advantageously can be a predetermined load profile that varies during the thread rolling operation.

The operational effect obtained by the exemplary embodiment according to the present invention is as follows. First, the thread rolling machine 1 possesses a load measuring device, i.e., the strain gauge 29, which measures distortion of a site where distortion occurs when the reaction force during the thread rolling operation is received, and a computer 27*a*, which calculates the load applied during the thread rolling operation from the value measured by the strain gauge 29. It will be appreciated that this makes it possible to continuously determine a load value during the high-precision thread rolling, due to the fact that the load during the thread rolling operation is determined on the basis of the distortion that occurs at the site where distortion occurs after receiving the reaction force during the thread rolling operation.

Furthermore, the strain gauge 29 is provided at the tension bar 28 disposed in the die feed direction. However, due to the fact that the tension bar 28 is a part where distortion occurs after the reaction force has been applied during the thread rolling operation, the distortion of the tension bar 28 is measured by the strain gauge 29, and the load during the thread rolling operation is determined on the basis of this measured value. Since the applied force can be calculated irrespective of the characteristics of hydraulic circuit 12, it is possible to obtain a more accurate value for the load, i.e., force, applied during the thread rolling operation. It should be noted that the attachment position of the strain gauge 29 is not limited to the tension bar 28; the strain gauge 29 advantageously can be attached to another part of the thread rolling machine 1 where distortion occurs after the reaction force has been applied during the thread rolling operation, making it is possible to determine the load during the thread rolling operation with greater accuracy by measuring the distortion at this part and determining the load during the thread rolling operation on the basis of this measured value.

In addition, if the feed volume of the roll die 3 is controlled by the controller 27 so that it equals the suitable predetermined load with consideration given to the load during the thread rolling operation as measured by the strain gauge 29, it is possible to determine the load during the thread rolling operation, to control the load during the thread rolling operation more accurately and, additionally, to provide the determined load as feedback to control the feed volume of the roll die 3, e.g., by controlling the position of the valve 10, so as to carry out thread rolling at the desired load.

It should be noted that the thread rolling machine 1 illustrated in FIGS. 1 and 2 is a circular die-type thread rolling machine. As previously mentioned, past efforts at load sensing involved sensing the fluid pressure within the hydraulic cylinder 7 with the pressure gauge 13 of the hydraulic circuit 12 that supplies operating fluid to the hydraulic cylinder 7. It will be appreciated that the load applied during the thread rolling operation was assumed to be the load obtained by multiplying the surface area of the hydraulic cylinder by the measured oil pressure. Accordingly, the assumed load was actually the load on the output side of the thread rolling machine 1. Since one did not account for error associated with either the thread rolling machine 1 or the pressure sensing gauge, i.e., the pressure gauge reading reflected errors due to flexure of the structural materials of the thread rolling machine as well as the characteristics of the hydraulic circuit 12, accurate measurements of the applied load could not be obtained. Thus, the hydraulically-based load value differed from the actual load during the thread rolling operation; the hydraulically-based load value was unsuitable for carrying out load control during the thread rolling operation at the desired accuracy.

However, in this exemplary embodiment according to the present invention, it is possible to more accurately determine the load during the thread rolling operation, without being affected by the characteristics of the hydraulic circuit 12, due to the fact that the value of the load during the thread rolling operation is determined on the basis of distortion of the tension bar 28, as described above.

In accordance with the exemplary embodiment of the present invention described above, it is possible to more accurately determine the load during the thread rolling operation and, thus, obtain more suitable machining conditions. By way of example, it is possible to include the applied load during the thread rolling operation as a control parameter in the thread rolling operation manual, since it is now possible to accurately determine the load during the thread rolling operation. Moreover, since the operation of the thread rolling machine 1 can now operate on the basis of known operating parameters, variations in load applied during the thread rolling operation resulting from differences between the experience level and perception of the various operators can be virtually eliminated. As a result, the thread rolling machine according to the present invention makes it possible to reduce the variations in product accuracy at the lot unit level and, thus, provide a stable supply of high-precision screws. Moreover, it will be appreciated that the useful life of the thread rolling machine advantageously can be extended simply by optimizing the machining conditions.

In short, the thread rolling machine of the present invention makes it possible, by determining the load applied during the thread rolling operation more accurately, and by optimizing the machining conditions based on the accurately determine load, to improve product quality and extend the useful life of the equipment. In addition, the accurately determined load advantageously can be provided as a feedback signal to the thread rolling machine during rolling operations, thus making it possible to further enhance product accuracy.

From the discussion above, it will be appreciated that the present invention can be included in an existing thread rolling machine as a load measurement system. In that case, the system could include a member that deforms under an applied load during a thread rolling operation, a strain gauge that generates a signal indicative of the deformation of the member under the applied load, and a computer that calculates the load applied during thread rolling operation based on the signal generated by the strain gauge. In an exemplary case, the member deforms in a direction parallel to the direction of the applied load. Moreover, the member can include a tension bar disposed in a direction parallel to the applied load. If desired, the computer can generate a feedback signal permitting the computer to control the applied load generated by the thread rolling machine. The load measurement system can be applied to a circular die-type thread rolling machine.

Moreover, the thread rolling machine of the present invention advantageously can include a die, a device for rotating the die, a device for generating a load applied to the die in a workpiece-feeding direction, a member that deforms under the applied load during a thread rolling operation, a strain gauge that generates a signal indicative of the deformation of the member under the applied load, and a computer that calculates the load applied during thread rolling operation based on the signal generated by the strain gauge. In an exemplary case, the member deforms in a direction parallel to the direction of the applied load. The member can include a tension bar disposed in a direction parallel to the applied load. If desired, the computer can generate a feedback signal permitting the computer to control the applied load generated by the thread rolling machine by controlling the output of the load generating device. The feedback signal can be employed to control the position of the flow control valve when the load generating device includes a hydraulic cylinder supplied with hydraulic fluid via an electrically operated flow control valve. Alternatively, feedback signal can be employed to control the applied load generated by the thread rolling machine by controlling rotation of the rotating device when the rotating device includes an electric motor. In either case, the thread rolling machine can be a circular die-type thread rolling machine.

From the discussion above, it will also be appreciated that a method for operating a thread rolling machine including a die, a die-rotating device, and a die-feeding device generating an applied load in the die-feeding direction, and a member that deforms under the applied load during a thread rolling operation is within the scope of the present invention. The method can include steps for generating a deformation signal indicative of the deformation of the member under the applied load, calculating an actual load applied during thread rolling operation based on the deformation signal, comparing the actual load to a predetermined load value to thereby determine a variance value, generating a feedback signal responsive the variance value, and applying the feedback signal to the thread rolling machine to thereby control the applied load generated by the thread rolling machine. If desired, the feedback signal can be applied the thread rolling machine as a control signal to the die-feeding device or as a control signal to the die-rotating device. The thread rolling machine can be a circular die-type thread rolling machine.

Although presently preferred embodiments of the present invention have been described in detail herein, it should be clearly understood that many variations and/or modifications of the basic inventive concepts herein taught, which may appear to those skilled in the pertinent art, will still fall within the spirit and scope of the present invention, as defined in the appended claims.

What is claimed is:

1. A load measurement system for a thread rolling machine forming a threaded member from a workpiece, comprising:

a member that deforms under a load applied to the workpiece during a thread rolling operation;

a strain gauge that generates a signal indicative of the deformation of the member under the applied load; and a computer that calculates the load applied to the workpiece during thread rolling operation based on the signal generated by the strain gauge.

2. The load measurement system as recited in claim 1, wherein the member deforms in a direction parallel to the direction of the applied load.

3. The load measurement system as recited in claim 1, wherein the member comprises a tension bar disposed in a direction parallel to the direction of the applied load.

4. The load measurement system as recited in claim 1, wherein the computer generates a feedback signal permitting the computer to control the applied load generated by the thread rolling machine.

5. The load measurement system as recited in claim 1, wherein the thread rolling machine is a circular die-type thread rolling machine.

6. The load measurement system as recited in claim 1, wherein one end of the member that deforms under the load is connected to the workpiece and an opposite end of the member receives a reaction force of a die, which is applied to the workpiece, such that the member is in tension when the load is applied to the workpiece, and the deformation of the member is indicative of the load applied to the workpiece.

7. A thread rolling machine forming a threaded member from a workpiece, comprising:

a die;

means for rotating the die;

means for generating a load applied to the die in a workpiece-feeding direction;

a member that deforms under the applied load during a thread rolling operation;

a strain gauge that generates a signal indicative of the deformation of the member under the applied load; and a computer that calculates the load applied during thread rolling operation based on the signal generated by the strain gauge.

8. The thread rolling machine as recited in claim 7, wherein the member deforms in a direction parallel to the direction of the applied load.

9. The thread rolling machine as recited in claim 7, wherein the member comprises a tension bar disposed in a direction parallel to the direction of the applied load.

10. The thread rolling machine as recited in claim 7, wherein the computer generates a feedback signal permitting the computer to control the applied load generated by the thread rolling machine by controlling the output of the load generating means.

11. The thread rolling machine as recited in claim 10, wherein:

the load generating means comprises a hydraulic cylinder supplied with hydraulic fluid via an electrically operated flow control valve; and the feedback signal controls the position of the flow control valve.

12. The thread rolling machine as recited in claim 7, wherein the computer generates a feedback signal permitting the computer to control the applied load generated by the thread rolling machine by controlling rotation of the rotating means.

13. The thread rolling machine as recited in claim 12, wherein the rotating means comprises an electric motor.

14. The load measurement system as recited in claim 7, wherein the thread rolling machine is a circular die-type thread rolling machine.

15. A method for operating a thread rolling machine including a die, a die-rotating device, and a die-feeding device generating an applied load in the die-feeding direction, and a member that deforms under the applied load during a thread rolling operation, comprising:

generating a deformation signal indicative of the deformation of the member under the applied load;

calculating an actual load applied during thread rolling operation based on the deformation signal;

comparing the actual load to a predetermined load value to thereby determine a variance value; generating a feedback signal responsive the variance value; and applying the feedback signal to the thread rolling ,machine to thereby control the applied load generated by the thread rolling machine.

16. The method as recited in claim 15, wherein the feedback signal is applied the thread rolling machine as a control signal to the die-feeding device.

17. The method as recited in claim 16, wherein:

the die-feeding devices comprises a hydraulic cylinder supplied with hydraulic fluid via an electrically operated flow control valve; and the feedback signal controls the position of the flow control valve.

18. The method as recited in claim 15, wherein the feedback signal is applied to the thread rolling machine as a control signal to the die-rotating device.

19. The method as recited in claim 18, wherein the die-rotating device comprises an electric motor.

20. The method as recited in claim 15, wherein the thread rolling machine is a circular die-type thread rolling machine.

* * * * *